US006448976B1

(12) United States Patent
Nitta et al.

(10) Patent No.: US 6,448,976 B1
(45) **Date of Patent: *Sep. 10, 2002**

(54) LIQUID CRYSTAL DRIVE CIRCUIT AND LIQUID CRYSTAL DISPLAY APPARATUS

(75) Inventors: Hiroyuki Nitta, Fujisawa; Atsuhiro Higa, Yokohama; Masashi Nakamura, Yokohama; Tsutomu Furuhashi, Yokohama; Satoru Tsunekawa, Higashimurayama; Hiroshi Kurihara, Mobara, all of (JP)

(73) Assignees: Hitachi, Ltd., Tokyo (JP); Hitachi Video and Information System, Inc., Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/044,522

(22) Filed: Mar. 19, 1998

(30) Foreign Application Priority Data

Mar. 19, 1997 (JP) ..... 9-065904

(51) Int. Cl.[7] ..... G09G 5/02; G09G 3/36
(52) U.S. Cl. ..... 345/698; 345/98
(58) Field of Search ..... 345/98–100, 89, 345/205, 213, 698

(56) References Cited

U.S. PATENT DOCUMENTS 5,365,284 A * 11/1994 Matsumoto et al. ..... 345/100
5,657,041 A * 8/1997 Choi ..... 345/99
5,764,213 A * 6/1998 Tanaka et al. ..... 345/98
5,796,379 A * 8/1998 Enomoto et al. ..... 345/100
5,900,856 A * 5/1999 Iino et al. ..... 354/100
5,940,061 A * 8/1999 Sato ..... 345/213

OTHER PUBLICATIONS

Hitachi LCD Controller/Driver LSI Data Book, Hitachi, Ltd., Mar. 1994, pp. 952–954.

* cited by examiner

*Primary Examiner*—Richard Hjerpe
*Assistant Examiner*—Duc Q. Dinh
(74) *Attorney, Agent, or Firm*—Mattingly, Stanger & Malur

(57) ABSTRACT

A liquid crystal drive circuit, which makes it possible to display low resolution display data on a high resolution liquid crystal panel while expanding and/or centering the display data, is provided. A multiscan control signal is inputted to a latch address control circuit and a data control circuit to control latch signals and the display data so as to latch single pixel data into a plurality of latches at the same time. The display data are latched with the expanding and/or centering operation, and outputted in synchronization with a line clock after being converted to gray scale voltages. Accordingly, it is possible to realize the lateral expansion and/or the centering operation. Further, it is also possible to realize a longitudinal expansion by adding a latch circuit between a latch circuit and a liquid crystal applied voltage generation circuit, and by outputting the data in synchronization with an expanded line clock.

6 Claims, 13 Drawing Sheets

| MULTISCAN CONTROL SIGNAL | | | FUNCTIONS |
|---|---|---|---|
| bit2 | bit1 | bit0 | |
| 0 | 0 | 0 | STANDARD LATCH: 2 PIXEL DATA LATCH |
| 0 | 0 | 1 | 2 PIXEL DATA-3 PIXEL CONVERSION LATCH (LEFT PIXEL EXPANSION) |
| 0 | 1 | 0 | 2 PIXEL DATA-3 PIXEL CONVERSION LATCH (RIGHT PIXEL EXPANSION) |
| 0 | 1 | 1 | 2 PIXEL DATA-4 PIXEL CONVERSION LATCH |
| 1 | 0 | 0 | USE PROHIBITED |
| 1 | 0 | 1 | USE PROHIBITED |
| 1 | 1 | 0 | CENTERING FUNCTION: 64 PIXEL PARALLEL LATCH |
| 1 | 1 | 1 | CENTERING FUNCTION: ALL PIXEL (128) PARALLEL LATCH |

| MULTISCAN CONTROL SIGNAL | | | FUNCTIONS |
|---|---|---|---|
| bit2 | bit1 | bit0 | |
| 0 | 0 | 0 | STANDARD LATCH: 2 PIXEL DATA LATCH |
| 0 | 0 | 1 | 2 PIXEL DATA-3 PIXEL CONVERSION LATCH (LEFT PIXEL EXPANSION) |
| 0 | 1 | 0 | 2 PIXEL DATA-3 PIXEL CONVERSION LATCH (RIGHT PIXEL EXPANSION) |
| 0 | 1 | 1 | 2 PIXEL DATA-4 PIXEL CONVERSION LATCH |
| 1 | 0 | 0 | USE PROHIBITED |
| 1 | 0 | 1 | USE PROHIBITED |
| 1 | 1 | 0 | CENTERING FUNCTION: 64 PIXEL PARALLEL LATCH |
| 1 | 1 | 1 | CENTERING FUNCTION: ALL PIXEL (128) PARALLEL LATCH |

FIG. 6

| CHIP ENABLE SIGNAL | REMAINING PIXEL NUMBER | MULTISCAN CONTROL SIGNAL | DRIVER OPERATION | | | | | | | |
|---|---|---|---|---|---|---|---|---|---|---|
| | | | PRECEDING DRIVER 103 - | | | | FOLLOWING DRIVER 103 - | | | |
| | | | 125 | 126 | 127 | 128 | 1 | 2 | 3 | 4 |
| "xx0" | ≧4 | — | — | — | — | — | NO LATCH | | | |
| "111" | 3 | 011 | — | L | L | R | R | — | — | — |
| | | 010/001 | — | L | L/R | R | NO LATCH | | | |
| | | 000 | — | L | R | — | NO LATCH | | | |
| "101" | 2 | 011 | — | — | L | L | R | R | — | — |
| | | 010/001 | — | — | L | L/R | R | — | — | — |
| | | 000 | — | — | L | R | NO LATCH | | | |
| "011" | 1 | 011 | — | — | — | L | L | R | R | — |
| | | 010/001 | — | — | — | L | L/R | R | — | — |
| | | 000 | — | — | — | L | R | — | — | — |
| "001" | 0 | 011 | — | — | — | — | L | L | R | R |
| | | 010/001 | — | — | — | — | L | L/R | R | — |
| | | 000 | — | — | — | — | L | R | — | — |

L: LEFT PIXEL LATCH
R: RIGHT PIXEL LATCH

LIQUID CRYSTAL DRIVE CIRCUIT AND LIQUID CRYSTAL DISPLAY APPARATUS

BACKGROUND OF THE INVENTION

1. Field of the Invention

The present invention relates to a liquid crystal display apparatus and its liquid crystal drive circuit which enables a liquid crystal panel to display graphic data even with a resolution different from a resolution of the liquid crystal panel.

2. Description of Related Art

As a conventional liquid crystal drive circuit, there is a TFT liquid crystal data driver HD66330T which is 192-channel 64-pixel×6-bit, described in pages 952–954, Hitachi LCD controller/driver LSI data book (Hitachi, Ltd., published March 1994).

FIG. 13 is a schematic illustration showing an internal structure of HD66330T. An operation of the conventional liquid crystal driver circuit will now be explained with reference to FIG. 13.

In FIG. 13, 1301 indicates a latch address control circuit, 1302 indicates a latch circuit (1), 1303 indicates a latch circuit (2), 1304 indicates a liquid crystal applied voltage generation circuit, 1305 indicates a clock for latching input display data, 1306 indicates a line clock with a period of one line, 1307 indicates the input display data, 1308 indicates latch signals, 1309 indicates latch circuit (1) output data, 1310 indicates latch circuit (2) output data, 1311 indicates base voltages for providing bases of the liquid crystal apply voltages, 1312 indicates liquid crystal applied voltage outputs, and 1313 indicates a chip enable signal.

First, the latch address control circuit 1301 generates the latch signals 1308 for latching the input display data 1307 successively, the input display data 1307 being inputted in synchronization with the clock 1305. The latch circuit (1) 1302 latches the input display data 1307 of 3-channel 1 pixel×6-bit successively in accordance with the latch signals 1308. Data of 192-channel 64-pixel×6-bit latched by the latch circuit (1) 1302 are then latched by the latch circuit (2) 1303 in synchronization with the line clock 1306. The data latched by the latch circuit (2) 1303 are decoded pixel by pixel. The applied voltages are generated according to the decoding results, and are outputted from the liquid crystal apply voltage generation circuit 1304.

FIG. 14 schematically illustrates a liquid crystal display apparatus with HD66330T, the conventional liquid crystal driver circuit. The prior art will now be explained with reference to FIG. 14.

In FIG. 14, 1401-U indicates an upper part of a liquid crystal drive circuit comprising an array of the conventional liquid crystal drive circuits, 1401-L indicates a lower part of a liquid crystal drive circuit comprising an array of the conventional liquid crystal drive circuits, 1402 indicates a scanning driver, 1403 indicates a controller ,1404 indicates a liquid crystal display panel, 1405 indicates input RGB display data to be inputted to the liquid crystal display apparatus ,1406 indicates a dot clock, 1407 indicates a horizontal sync signal, 1408 indicates a vertical sync signal, 1409 indicates a display timing signal, 1410-U indicates upper display data, 1410-L indicates lower display data, 1411-U indicates an upper clock generated by halving a frequency of the dot clock, 1411-L indicates a lower clock generated by halving a frequency of the dot clock, 1412 indicates the first line marker indicating a start of the scanning operation and 1413 indicates a shift clock with the same frequency as that of the horizontal sync signal.

As shown in FIG. 14, the controller 1403 divides the dot clock 1406 into one half of the original frequency, and outputs, the upper clock 1411-U and the lower clock 1411-L. The controller 1403 also selects the input display data 1405 having every RGB data of odd and even number pixels, and outputs the R data of the odd number pixels, the B data of the odd number pixels and the G data of the even number pixels as the upper display data 1410-U, and outputs the G data of the odd number pixels, the R data of the even number pixels and the B data of the even number pixels as the lower display data 1410-L.

The liquid crystal drive circuits 1401-U and 1401-L latch the display data 1410-U and 1410-L outputted from the controller 1403 at trailing edges of the clocks 1411-U and 1411-L, and output the liquid crystal applied voltages to every pixel at the leading edge of the line clock 1306.

The scanning driver 1402 selects the lines in accordance with the first line marker 1412 and the shift clock 1413 to realize a display on the liquid crystal panel. Accordingly, a train of the input display data 1405 is displayed as they are on the liquid crystal panel. The input display data 1405 usually have the same resolution as that of the liquid crystal panel 1404, and are displayed over the whole display area of the liquid crystal panel.

SUMMARY OF THE INVENTION

In the prior art described above, the display could not be carried out properly when the display data with a lower resolution than that of the liquid crystal panel are to be inputted. FIG. 15 is a schematic illustration of a case where the display data with a lower resolution than that of the liquid crystal panel are to be inputted.

When the display data 1405 with a lower resolution than that of the liquid crystal panel are inputted, no data is latched at the liquid crystal drive circuits located at right ends of the liquid crystal drive circuits 1401-U and 1401-L because there are less display data in the lateral direction and effective display area for the input display data 1405 is displayed at the upper left. A position of such a display may not be well balanced with respect to the liquid crystal panel 1404. Furthermore, the data display area in such a display would be smaller compared to the total display area of the liquid crystal panel 1404. Accordingly, a large display area may not be utilized effectively due to the increase of the ineffective display area if the liquid crystal panel of a higher resolution is used. These are presented as problems.

Normally, there are data in the ineffective display interval which occurs between the effective display interval and a pulse of the line clock 306. As shown in FIG. 15, the problems of not being able to latch the data in the right end side of the driver as described above may also be observed when the total number of the pixels in one line is less than a number of pixels in the lateral direction of the liquid crystal panel 1404, even if the data during the ineffective display interval are additionally used.

The object of the present invention is to provide a liquid crystal drive circuit enabling a decrease in the ineffective display area by expanding the display data, and to display the display data in the middle part of the liquid crystal panel even when the display data with a lower resolution than that of the liquid crystal panel are to be inputted.

General features of typical embodiments of the inventions disclosed in the present application will now be explained as follows.

The present invention in the first embodiment provides a liquid crystal drive circuit comprising: a latch address control circuit for generating a latch signal or a plurality of latch signals in parallel according to a parallel latch number control signal specifying a number of the display data to be latched in parallel; a data control circuit for controlling display data to be latched in parallel according to the control signal; a the-first hold circuit for latching the display data controlled by the data control circuit for an amount of output data lines according to the latch signals,. and holding the latched data; a second hold circuit for latching the display data held in the first hold circuit in parallel for an amount of the output data lines according to a horizontal sync signal, and holding the latched data; and a gray scale voltage output circuit for selecting gray scale voltages generated by dividing base voltages in accordance with the display data held in the second hold circuit, and buffering and outputting the selected data.

Further, in the second embodiment, the present invention provides a liquid crystal drive circuit which further comprises a third hold circuit for latching the display data held in the second hold circuit in parallel for an amount of the output data lines according to a horizontal sync signal with a frequency M/N times (M, N are natural numbers and $M \geqq N$) higher than a frequency of the horizontal sync signal for the input display data, holding the latched data, and outputting the display data held therein to the gray scale voltage output circuit, replacing the second hold circuit in the first embodiment.

Alternatively, the parallel latch number control signal in the first and second embodiments may indicate information including at least one of parallel latch number information for a lateral data expansion display and parallel latch number information for a centering display; and the latch address control circuit may comprise latch signal generation means for generating pulses for the latch signals, a number of the pulses corresponding to the control signal; latch address select means for selecting the hold circuit addresses where the display data are to be held; and decode means for decoding outputs of the latch signal generation means and the latch address select means to convert them into the latch signal.

Further, in the first and second embodiments, the parallel latch number control signal may indicate parallel latch number information for a lateral data expansion display; and the data control circuit may comprise a plurality of data select circuits provided in equal number to the parallel latch number for the lateral data expansion display into which a plurality of the pixels of the display data are latched in parallel; and data select control means for distributing the display data to every one of the data select circuits and controlling every one of the data select circuits to select one of a plurality of the display data in accordance with the hold circuit addresses and the parallel latch number control signal.

Further, the liquid crystal drive circuits in the first and second embodiments may further comprise chip enable signal output control means for detecting a number of the latch signals yet to be outputted, and outputting information regarding the detected number as a chip enable signal to the other liquid crystal drive circuit.

The chip enable output control means may detect a number of said latch signals yet to be outputted, the number being equal to the maximum parallel latch number or less.

Further, the liquid crystal drive circuits in the first and second embodiments may further comprise chip enable input control means for accepting a chip enable signal indicating information regarding a number of the latch signals yet to be outputted, and determining a number of the display data in the first parallel latch according to the chip enable signal and the first parallel latch number control signal.

Here, it is preferable to have the chip enable input control means which accepts the chip enable signal input, and prohibits the data latch operation when a number, which is calculated by subtracting the latch signal number to-be-outputted indicated in the chip enable signal from the parallel latch data number indicated in the first parallel latch number control signal, is equal to 0 or less, and sets the number calculated as the first parallel latch display data number when the number calculated is equal to 1 or more.

Further, the present invention makes it possible to provide a liquid crystal display apparatus comprising: control means for outputting a liquid crystal horizontal sync signal with a frequency N ($N \geqq 1$) times larger than a frequency of the input horizontal sync signal; a scanning circuit for scanning successively according to said liquid crystal horizontal sync signal; and M (M is an integer equal to 1 or more) number of liquid crystal drive circuits of the present invention; wherein the input display data is displayed at the liquid crystal panel with at least one of an expansion display format and a centering display format.

BRIEF DESCRIPTION OF THE DRAWINGS

FIG. 6 is an illustration of the definition of a chip enable signal of the liquid crystal drive circuit in the first embodiment of the present invention;

DETAILED DESCRIPTION OF THE PREFERRED EMBODIMENTS

Embodiments of the present invention will now be explained with reference to the figures.

Embodiment 1

A liquid crystal drive circuit in the first embodiment of the present invention will now be explained with reference to FIGS. 1–11.

Figures 1, 2:
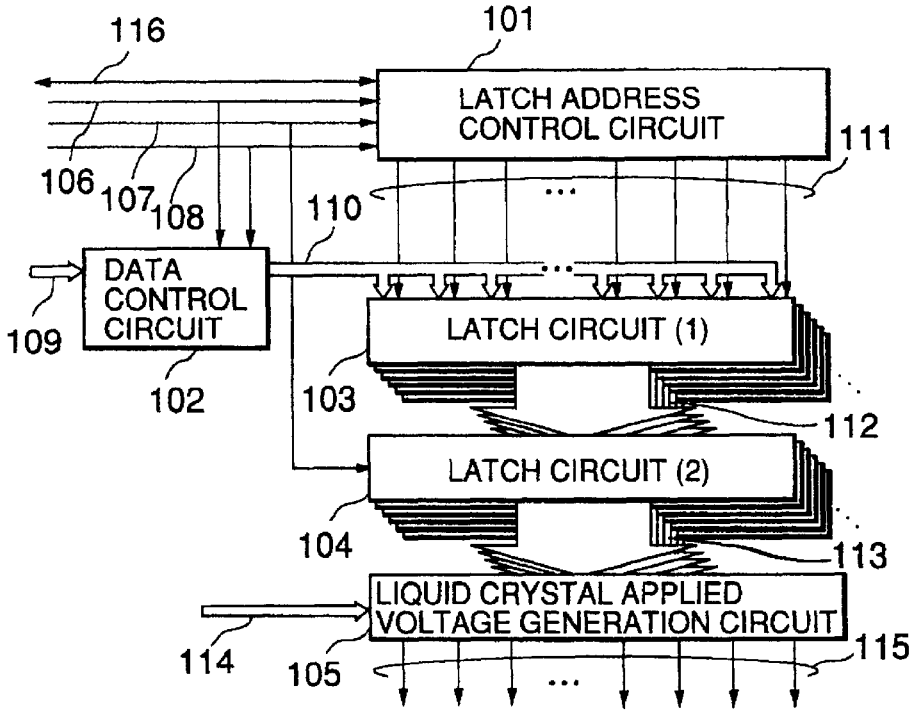
FIG. 1 is a block diagram showing a schematic configuration of a liquid crystal drive circuit in the first embodiment of the present invention.
FIG. 2 is a block diagram showing internal configurations of a latch address control circuit, a data selector control circuit and a latch circuit (1) in the liquid crystal drive circuit in the first embodiment of the present invention.

FIG. 1 is a block diagram of a liquid crystal driver in the first embodiment of the present invention.

In FIG. 1, 101 indicates a latch address control circuit, 102 indicates a data control circuit, 103 indicates a latch circuit (1), 104 indicates a latch circuit (2), 105 indicates a liquid crystal applied voltage generation circuit, 106 indicates a clock for latching input display data, 107 indicates a line clock with one line period, 108 indicates a multiscan control signal for commanding expansion or centering operations, 109 indicates input display data, 110 indicates display data controlled by the data control circuit, 111 indicates latch signals, 112 indicates latch circuit (1) output data, 113 indicates latch circuit (2) output data, 114 indicates base voltages for providing bases of the liquid crystal applied voltages, 115 indicates liquid crystal applied voltage outputs, and 116 indicates a chip enable signal.

Next, operations of the liquid crystal drive circuit will be explained with reference to the block diagram shown in FIG. 1.

First, a data latch operation will now be described.

As shown in FIG. 1, the latch address control circuit 101 outputs the latch signals 111 to the latch circuit (1) 103 in which the display data 110 are latched in accordance with the multiscan control signal 108 when the input enable signal 116 turns active.

The data control circuit 102 accepts the input display data 109. The data control circuit 102 then rearranges an order of the input display data 109 according to the multiscan control signal 108, and outputs the display data 110.

The latch circuit (1) 103 latches the rearranged display data 110 in accordance with the latch signals 111 into internal latches each corresponding to a respective one of the liquid crystal applied voltage outputs 115.

The latch address control circuit 101 returns to the initial state in accordance with the line clock 107.

Accordingly, it is possible to execute the data latch operation.

Next, a data output operation will be described.

As shown in FIG. 1, the latch circuit (1) output data 112 are latched by the latch circuit (2) 104 at a timing when the line clock 107 becomes active after all the display data 109 for one line period are latched by the latch circuit (1) 103.

The latch circuit (2) output data 113 are inputted to the liquid crystal applied voltage generation circuit 105. The liquid crystal applied voltage generation circuit 105 selects gray scale voltages generated from the base voltage 114 for every pixel, buffers the selected voltages, and then outputs the selected voltages as the liquid crystal applied voltage outputs 115.

Accordingly, it is possible to execute the data output operation.

Next, a lateral expansion data latch operation of the data latch operation will be described in detail with reference to FIG. 2, FIG. 3 and FIG. 4.

Here, an example is described of the liquid crystal drive circuit in which the first and second pixels counting from the left edge of the liquid crystal panel are designated as a left pixel and a right pixel respectively, and these adjacent two pixels are inputted in parallel. Further, the liquid crystal drive circuit in this example is provided with four types of lateral expansion data latch operation and two types of lateral centering data latch operation, and outputs 384-channel 128-pixel data.

FIG. 2 shows the definition of the multiscan signal 108 when the multiscan signal 108 is assumed to be a 3-bit signal. FIG. 3 is a block diagram showing detailed internal configurations of the latch address control circuit 101, the data control circuit 102 and the latch circuit (1) 103.

Figure 3:
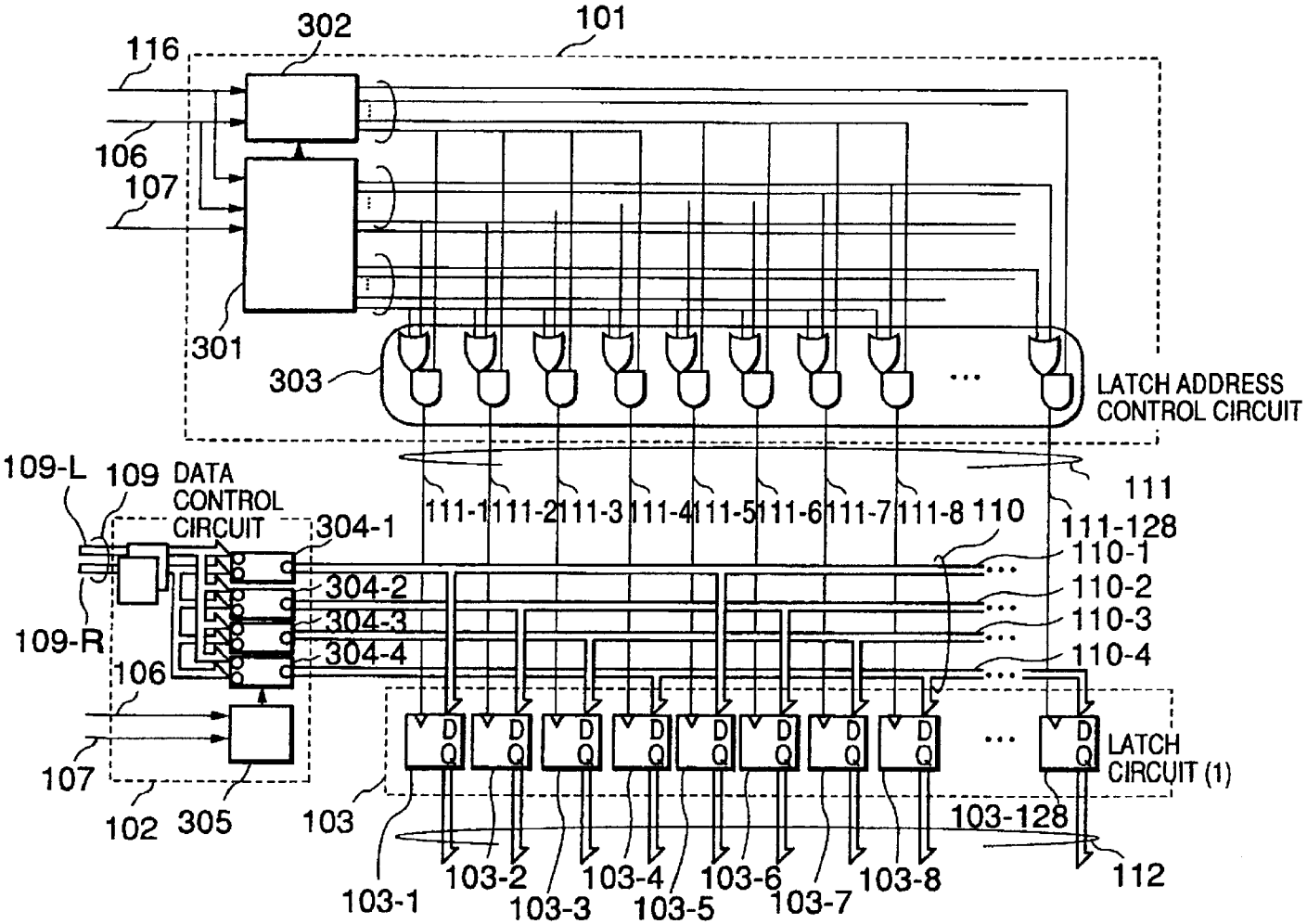
FIG. 3 is an illustration of the definition of a multiscan control signal of the liquid crystal drive circuit in the first embodiment of the present invention.

In FIG. 3, 301 is a latch signal generation circuit, 302 indicates a latch address selector circuit, 303 indicates a decode circuit, 304-~304-4 indicate data selectors corresponding to the latches for the pixels numbered 4m, 4m+1, 4m+2, 4m+3 (m is 0 or a positive integer) respectively, and 305 indicates a data selector circuit. Here, 109-L indicates the left pixel data of the display data 109, and 109-R indicates the right pixel data of the display data 109. The display data outputted from the data selectors 304-1~304-4 are indicated as 110-1~110-4, respectively. Latch signals corresponding to all of the 128 pixels are indicated as 111-1~111-128. Latches corresponding to all of the 128 pixels are indicated as 103-1~103-128. To simplify the figure, 111-9~111-127 of the latch signals and 103-9-103~127 of the latches are not shown in FIG. 3.

As shown in FIG. 2, the display data of two pixels are latched without any conversion when the multiscan signal 108 indicates "000". The latch clock generation circuit 301 of the latch address control circuit 101 shown in FIG. 3 generates clock pulses for the two pixels in parallel, the latch address selector circuit 302 selects the latches for latching the data, and the decode circuit 303 outputs the corresponding latch signals 111.

Figure 4:
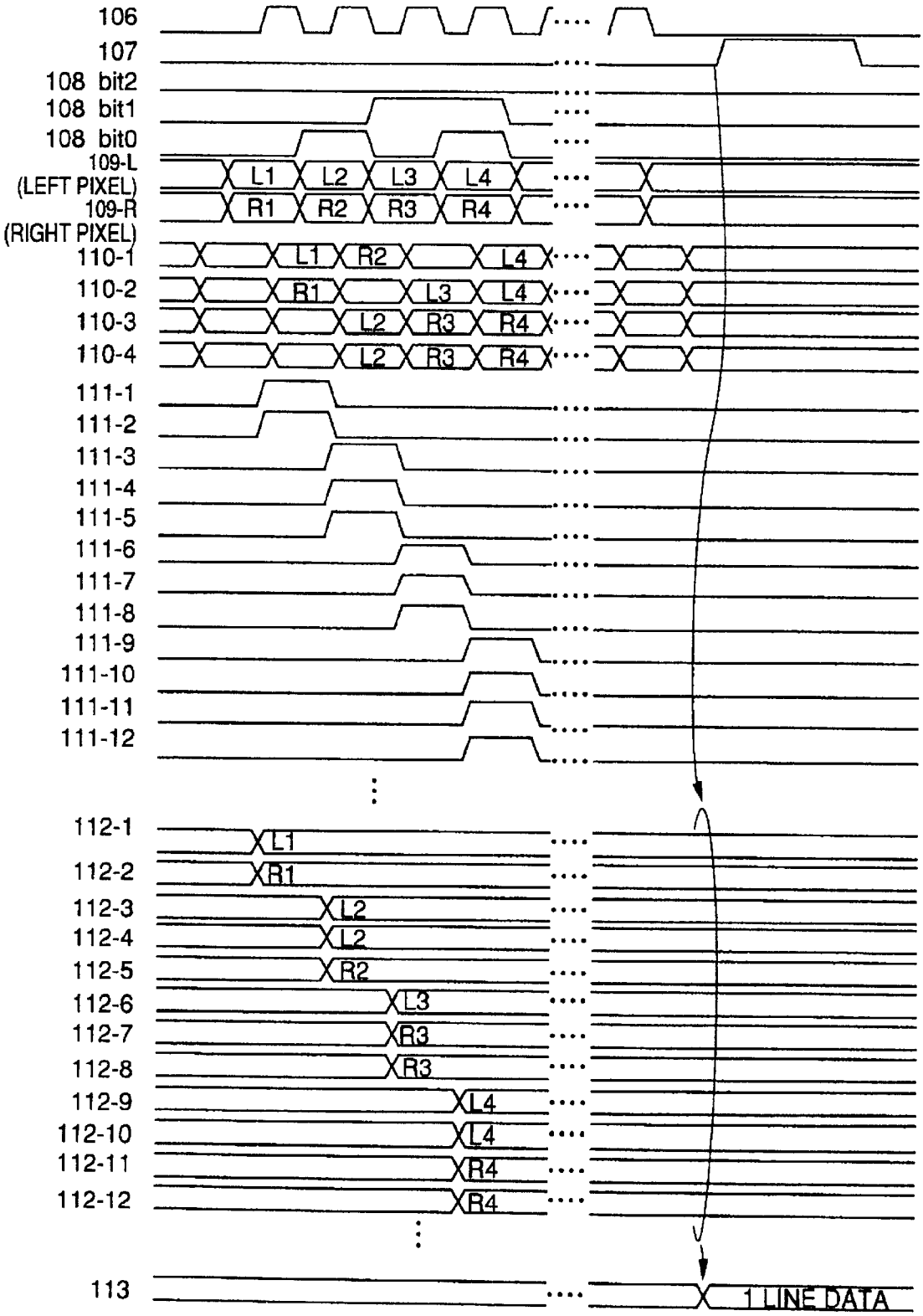
FIG. 4 is a timing diagram during a display data lateral expansion operation of the liquid crystal drive circuit in the first embodiment of the present invention.

Concretely, the latch signals 111-1 and 111-2, which are inputted to the latch 103-1 for the first pixel and the latch 103-2 for the second pixel respectively, become active at timings shown in FIG. 4. The latches 103-1 and 103-2 are disposed in the latch circuit (1) 103 by which the input data 110 are latched. The data select circuit 305 controls the data selector 304-1 to select the left pixel data 109-L and the data selector 304-2 to select the right pixel data 109-R. The data selectors are then controlled to output the display data 110-1 and 110-2 at timings shown in FIG. 4.

The latch circuit (1) 103 enables latching of the two pixel data by latching L1 of the left pixel data 109-L for the first pixel, and latching R1 of the right pixel data 109-R for the second pixel.

When the multiscan control signal 108 indicates "001", the latch operation is carried out by expanding the left pixel, converting the two pixel input display data into three pixel data, and latching the converted ones.

Concretely, the latch address control circuit 101 of FIG. 3 turns the latch signals 111-3, 111-4 and 111-5 active at timings shown in FIG. 4 where the latch signals 111-3, 111-4 and 111-5 respectively correspond to the latch 103-3 for the third pixel, the latch 103-4 for the fourth pixel and the latch 103-5 for the fifth pixel of the latch circuit (1) 103 by which the display data 110 are latched. The data select circuit 305 controls the data selectors 304-3, 304-4 to select the left pixel data 109-L and the data selector 304-1 to select the right pixel data 109-R. The data selectors are then controlled to output the display data 110-3, 110-4 and 110-1 at timings shown in FIG. 4.

The latch circuit (1) 103 enables execution of the two pixel data three pixel conversion latch (the left pixel expansion) by latching L2 of the left pixel data 109-L shown in FIG. 4 for the third and fourth pixels, and latching R2 of the right pixel data 109-R for the fifth pixel.

When the multiscan control signal 108 indicates "010", the latch operation is carried out while expanding the right pixel, converting the two pixel input display data into three pixels, and latching the converted ones.

Concretely, the latch address control circuit 101 of FIG. 3 turns the latch signals 111-6, 111-7 and 111-8 active at timings shown in FIG. 4 where the latch signals 111-6, 111-7 and 111-8 respectively correspond to the latch 103-6 for the sixth pixel, the latch 103-7 for the seventh pixel dan the latch 103-8 for the eighth pixel of the latch circuit (1) 103 by which the display data 110 are latched. The data select circuit 305 controls the data selector 304-2 to select the left pixel data 109-L and the data selectors 304-3, 304-4 to select the right pixel data 109-R. Then, the data selectors are controlled to output the display data 110 at timings shown in FIG. 4.

The latch circuit (1) 103 enables execution of the two pixel data three pixel conversion latch (the right pixel expansion) by latching L3 of the left pixel data 109-L for the sixth pixel, and latching R3 of the right pixel data 109-R for the seventh and eighth pixels.

When the multiscan control signal 108 indicates "011", the latch operation is carried out while expanding the left and right pixels, converting the two pixel input display graphic data into four pixels, and latching the converted ones.

Concretely, the latch address control circuit 101 of FIG. 3 turns the latch signals 111-9~111-12 active at timings shown in FIG. 4 where the latch signals 111-9~111-12 respectively correspond to the latch 103-9 for the ninth pixel to the latch 103-12 for the twelfth pixel of the latch circuit (1) 103 by which the display data 110 are latched. The data select circuit 305 controls the data selectors 304-1, 304-2 to select the left pixel data 109-L and the data selectors 304-3, 304-4 to select the right pixel data 109-R. Then the data selectors are controlled to output the display data 110 at timings shown in FIG. 4.

The latch circuit (1) 103 enables execution of the two pixel data-four pixel conversion latch by latching L4 of the left pixel data 109-L for the ninth and tenth pixels, and latching R4 of the right pixel data 109-R for the eleventh and twelfth pixels.

Accordingly, it is possible to execute the lateral expansion data latch operation.

Next, a lateral centering data latch operation of the data latch operation will be described in detail with reference to FIG. 2, FIG. 3 and FIG. 5. Here, an example is described of the liquid crystal drive circuit which is to output the 384-channel 128-pixel data in the same way as the example of the lateral expansion data latch operation.

As shown in FIG. 2, data for a single pixel is latched for 64 pixels in parallel when the multiscan signal 108 indicates "110".

Figure 5:
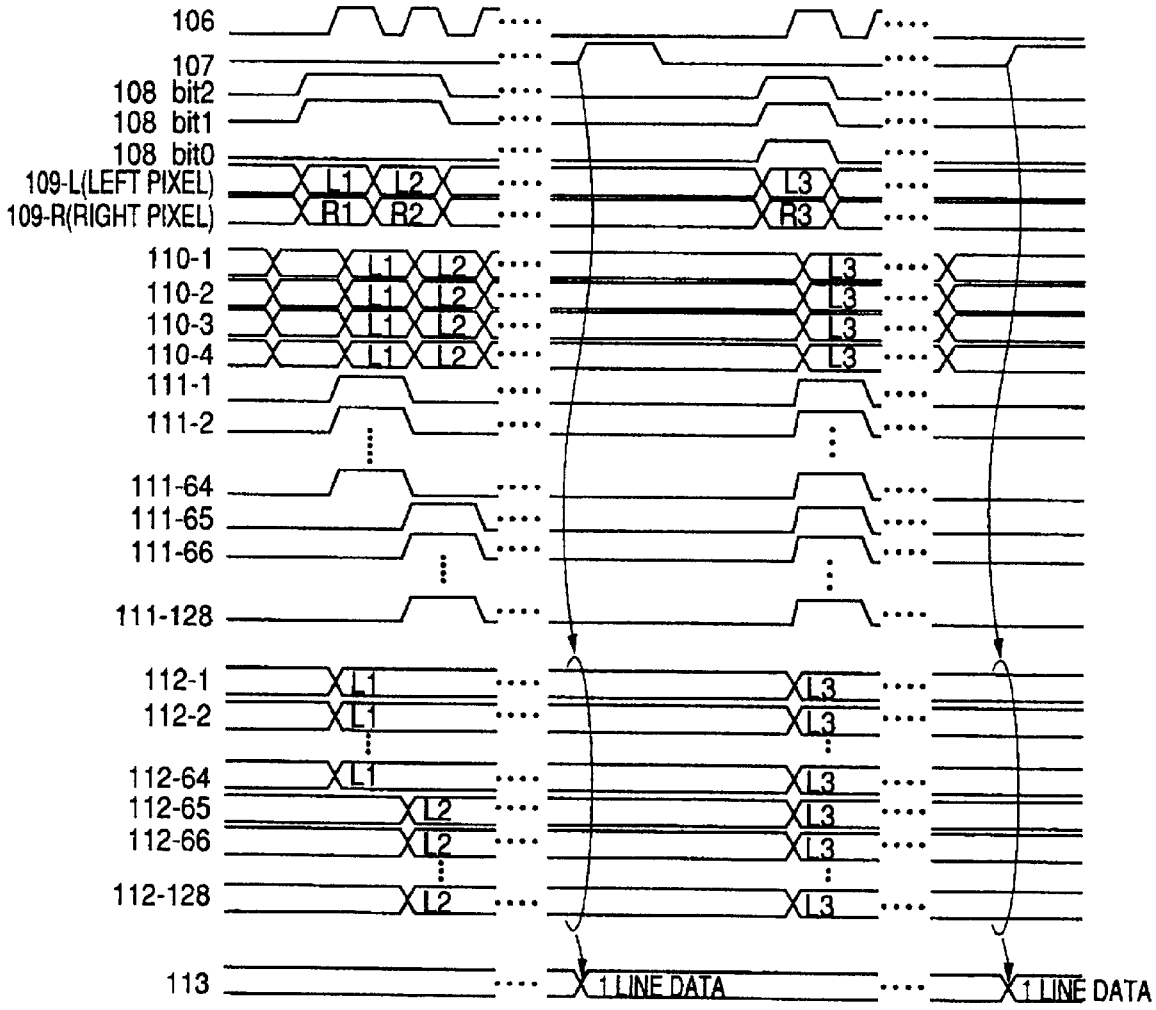
FIG. 5 is a timing diagram during a display data lateral centering operation of the liquid crystal drive circuit in the first embodiment of the present invention.

Concretely, when the latch address indicates the 64th pixel or before, the latch address control circuit 101 turns the latch signals 111-1~111-64 active at timings shown in FIG. 5 where the latch signals 111-1~111-64 respectively correspond to the latch 103-1 for the first pixel to the latch 103-64 for the 64th pixel of the latch circuit (1) 103 by which the display data 110 are latched.

When the latch address is after the 64th pixel, the latch address control circuit 101 turns the latch signals 111-65~111-128 active at timings shown in FIG. 5 where the latch signals 111-65~111-128 respectively Correspond to the latch 103-65 for the 65th pixel to the latch 103-128 for the 128th pixel of the latch circuit (1) 103 by which the display data 110 are latched.

Further, the data select circuit 305 controls the data selectors 304-1~304-4 to select the left pixel data 109-L and to output the display data 110 at timings shown in FIG. 5.

The latch circuit (1) 103 enables execution of the 64 pixel parallel latch operation by latching L1 of the left pixel data 109-L for the first to 64th pixels, and latching L2 of the left pixel data 109-L for the 65th to 128th pixels at timings shown in FIG. 5.

When the multiscan signal 108 indicates "111", data for a single pixel is latched for all the pixels (128 pixels) in parallel.

Concretely, the latch address control circuit 101 turns the latch signals 111-1~111-128 active at timings shown in FIG. 5 where the latch signals 111-1~111-128 respectively correspond to the latch 103-1 for the first pixel to the latch 103-128 for the 128th pixel of the latch circuit (1) 103 by which the display data 110 are latched. Further, the data select circuit 305 controls the data selectors 304-1~304-4 to select the left pixel data 109-L and to output the display data 110 at timings shown in FIG. 5.

The latch circuit (1) 103 enables execution of the all pixel (128 pixels) parallel latch operation by latching L3 of the left pixel data 109-L for the first to 128th pixels at timings shown in FIG. 5.

Accordingly, it is possible to execute the lateral centering data latch operation.

The liquid crystal drive circuit outputs the chip enable signal 116 when the above latch operations are completed for all the pixels.

Next, an operation with the chip enable signal 116 will be described with reference to FIG. 6 and FIG. 7.

In order to utilize the liquid crystal drive circuit of the present invention in the same way as the prior art in which a plurality of the liquid crystal drive circuits are utilized to drive a liquid crystal panel, a liquid crystal drive circuit (called the following driver hereafter), which follows the other liquid crystal drive circuit and latches the consecutive display data, has to start its latch operation at the end of the latch operation of the preceding liquid crystal drive circuit (called the preceding driver hereafter). For that purpose, the preceding driver outputs the chip enable signal 116 to the following driver.

Depending on an indicated combination of the multiscan control signal 108 by which the lateral expansion latch operations are actualized, a number of the latches in which the latch operations have not finished (called the remaining pixel number hereafter) may not coincide with the parallel latch number indicated by the multiscan control signal 108 at the final latch operation. In such a case, a parallel display data latch operation may be executed with the latch 103-128 for the 128th pixel of the preceding driver and the latch 103-1 for the first pixel of the following driver.

FIG. 6 shows a relationship among the chip enable signal 116, the remaining pixel number, the multiscan control signal 108 after the chip enable signal 116 becomes effective, and an operation of parallel latching among the drivers.

The chip enable signal 116 is the 3-bit signal in which the zero bit indicates a chip enable state for the following driver, and the bits 2 and 1 indicate the remaining pixel number of the preceding driver. The following driver determines its latch operation as shown in FIG. 6 in accordance with information of the remaining pixel number indicated by the bits 2, 1 and the multiscan control signal 108 when the bit 0 is set active.

Figure 7:
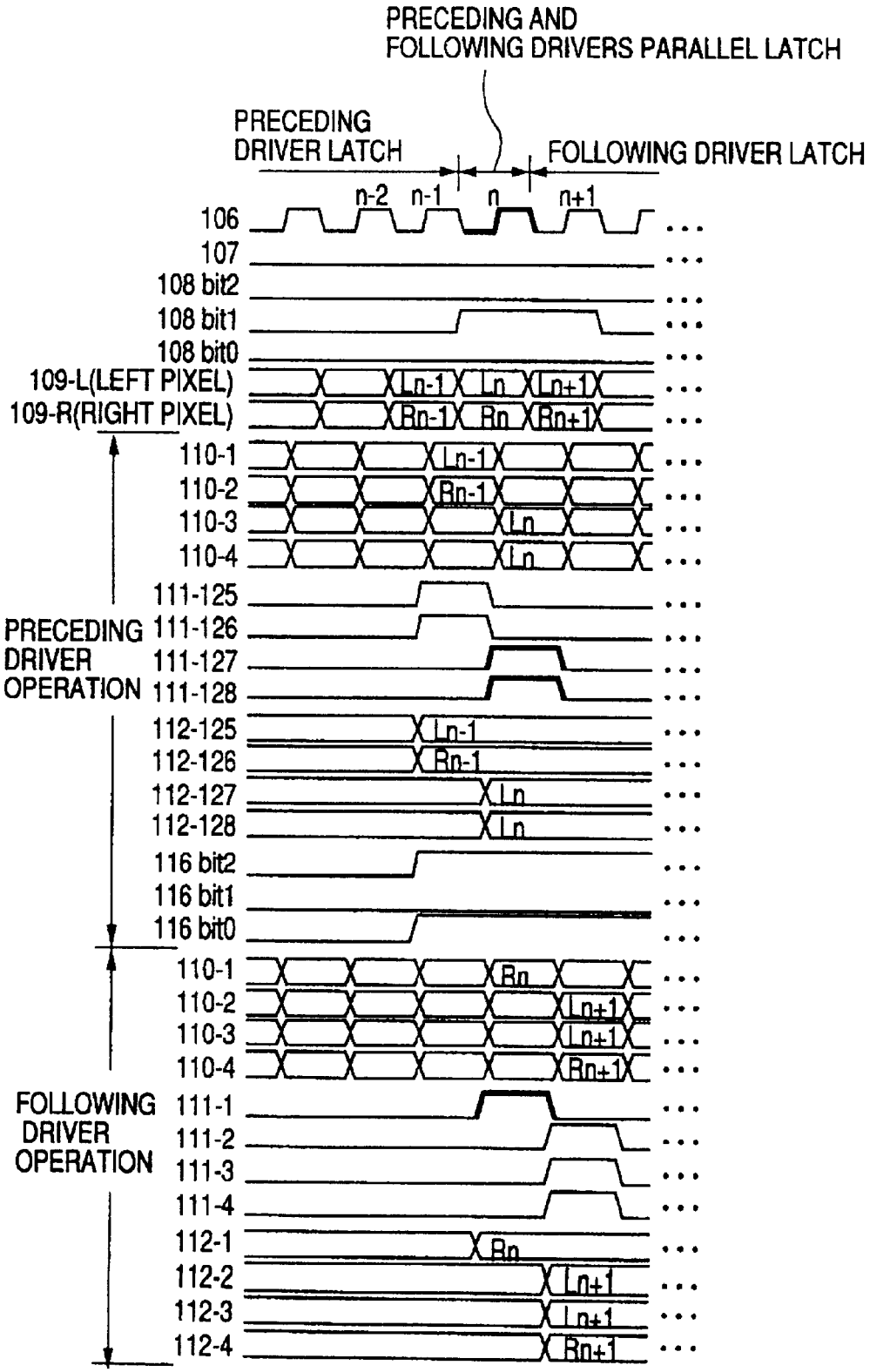
FIG. 7 is a timing diagram of the chip enable signal of the liquid crystal drive circuit in the first embodiment of the present invention.

FIG. 7 shows an example of the display data parallel latch operation among the preceding and following drivers.

As shown in FIG. 7, when the 127th and 128th pixels are the two remaining pixels in the preceding driver, and the multiscan control signal 108 indicates "010(three pixel expansion—right pixel expansion)", it is required that the data selector 304-3 selects the left pixel data 109-L, and the data selector 304-4 selects the right pixel data 109-R. Then, the selected data are latched by the latches 103-127, 103-128 for the remaining pixels respectively in the preceding driver, and the data selectors 304-1 select the right pixel data 109-R, and the selected data is latched by the latch 103-1 for the first pixel in the following driver. In this case, the chip enable signal 116 is set active at the n—1 clock.

Information regarding the remaining pixel number of the chip enable signal 116 is detected at the latch address control circuit 101 generating the latch signals 111. As shown in FIG. 7, the latch signals 111, which are provided for a number of the pixels in the parallel latch operation indicated by the multiscan control signal 108 starting from the latch signal 111-125 for the 125th pixel, are simultaneously turned active (high level) at the n—1 timing. For example, the remaining pixel number becomes 2 if the multiscan control signal 108 indicates "000 (two pixel parallel latch)" at the n—1 clock. In other words, the remaining pixel number can be determined from locations of the latch signals 111 that are active and the multiscan control signal 108. The chip enable signal 116 is set to "101" as shown in FIG. 6 when the remaining pixel number is 2.

When there are two remaining pixels and the multiscan control signal 108 indicates "000 (two pixel latch)" instead of the above mentioned case where there are two remaining pixels and the multiscan control signal 108 indicates "010 (three pixel expansion—right pixel expansion)", the data selector 304-3 of the preceding driver selects the left pixel data 109-L, and the data selector 304-4 selects the right pixel data 109. The selected data are latched by the latches 103-127, 103-128 for the remaining pixels respectively in the preceding driver, and no data is latched in the following driver. The following driver starts its display data latch operation from the n+1 clock according to the multiscan control signal 108.

Accordingly, it is possible to realize the parallel latch operation in accordance with the multiscan control signal 108 among the preceding and following drivers by outputting the chip enable signal 116 having information of the remaining pixel number.

With a liquid crystal module utilizing the liquid crystal drive circuit with the lateral expansion data latching function and the lateral centering data latching function of the present invention described above, it is possible to realize the lateral expansion display and the lateral centering display using the input display data having a display pixel number that does not match display pixel number of the liquid crystal panel.

Figure 8:
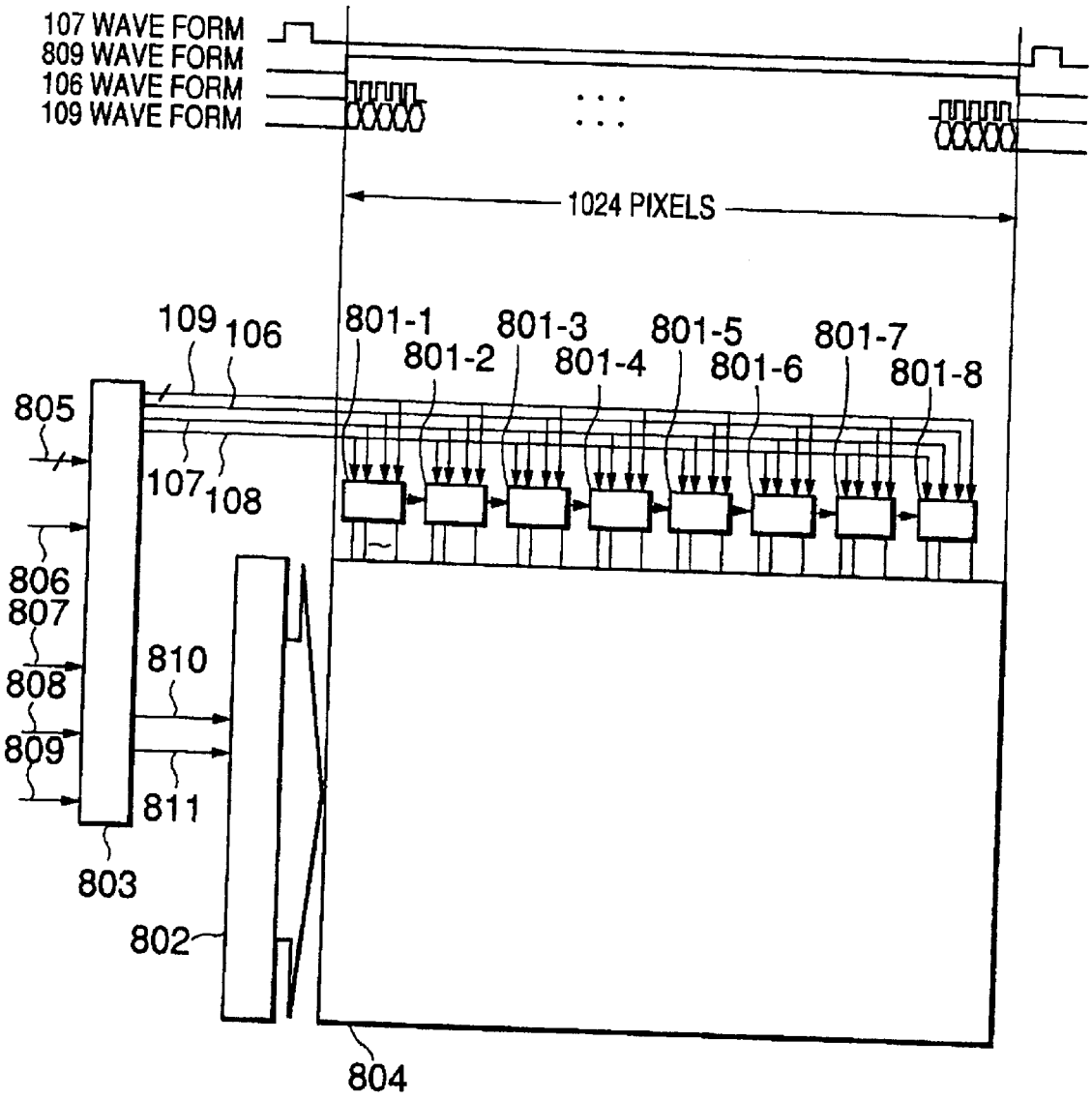
FIG. 8 is a block diagram showing a schematic configuration of a liquid crystal display apparatus comprising a plurality of the liquid crystal drive circuits of the first embodiment of the present invention.
Figure 9:
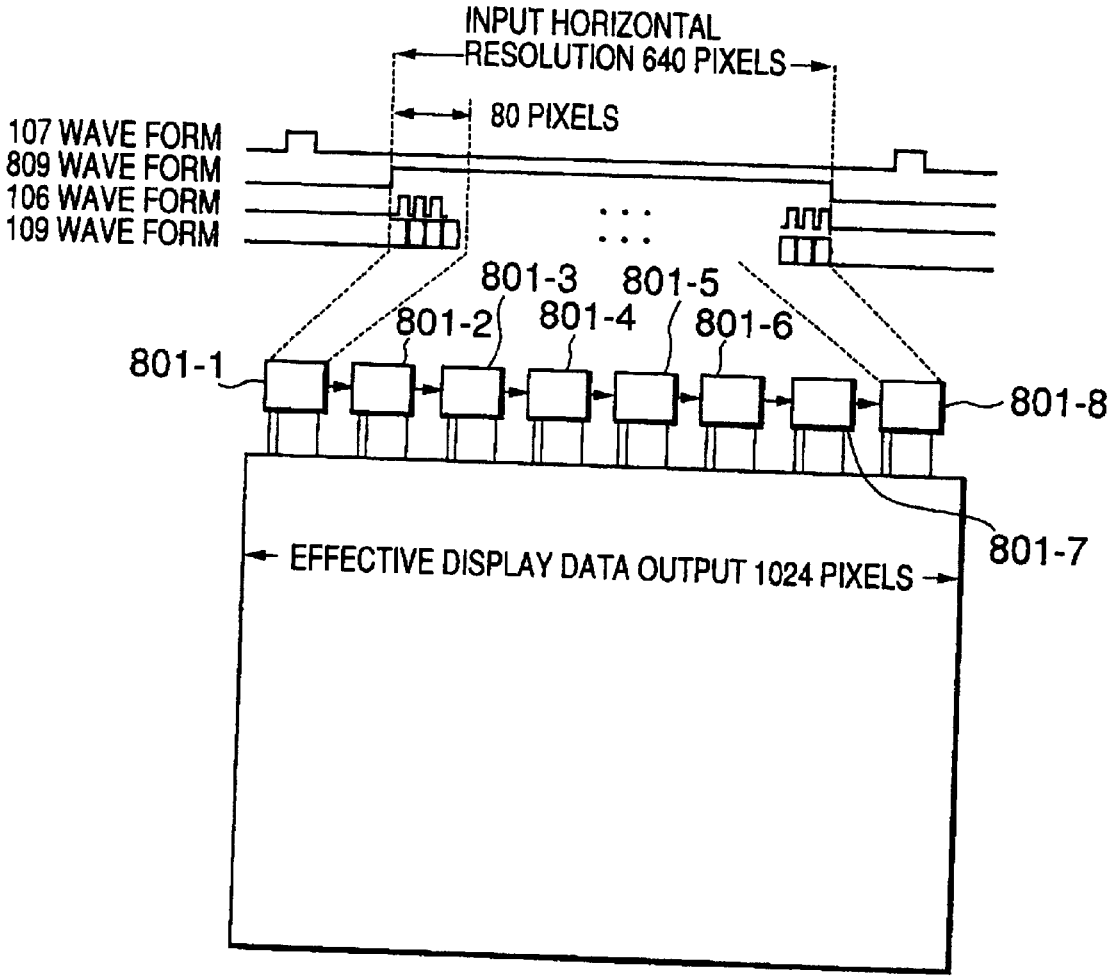
FIG. 9 is an explanatory illustration showing a 1.0-time display of a liquid crystal display apparatus comprising a plurality of the liquid crystal drive circuits of the first embodiment of the present invention.
Figure 10:
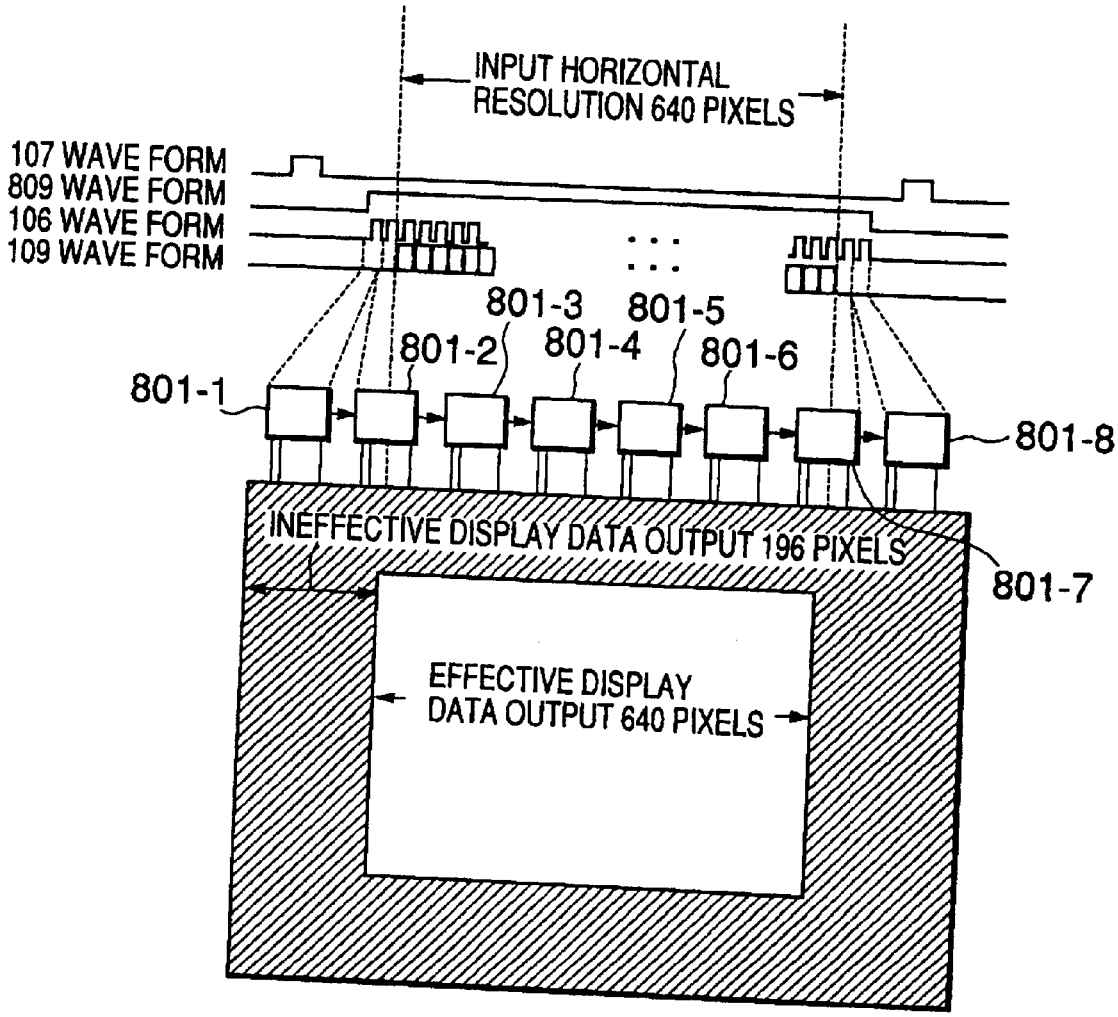
FIG. 10 is an explanatory illustration showing a 1.6-time display of a liquid crystal display apparatus comprising a plurality of the liquid crystal drive circuits of the first embodiment of the present invention.

These features will now be explained with reference to FIG. 8 showing an example of the configuration of the liquid crystal display apparatus and timings of signals, and FIGS. 9, 10 which are explanatory illustrations showing timings of low resolution display data and a display method for displaying the data in the liquid crystal display apparatus of FIG. 8.

In FIGS. 8 to 10, 801-1~801-8 are liquid crystal drive circuits of the present invention each with 384-channel 128-pixel output, 802 indicates a scanning driver, 803 indicates a controller, 804 indicates a liquid crystal panel with 1024×768 pixels, 805 indicates input RGB display data inputted to the liquid crystal display apparatus, 806 indicates a dot clock, 807 indicates a horizontal sync signal, 808 indicates a vertical sync signal, 809 indicates a display timing signal, 810 indicates a first line marker, and 811 indicates a shift clock.

In a normal operation, the display data with the 1024×768 pixel resolution, the same resolution as the panel, are inputted to the liquid crystal panel 804, the display data are inputted successively to the liquid crystal circuits 801-1~801-8, and the multiscan control signal 108 is usually set to "000 (two pixel parallel latch)". Thus, it is possible to complete the display of 1024 pixels with 512 clock cycles of the clock 106.

Next, methods for a lateral expansion display with an expansion rate of 1.6 and a lateral centering display with an expansion rate of 1.0 will be described. In this example, the liquid crystal display apparatus is provided with the liquid crystal panel 804 with 1024×768 pixels and eight liquid crystal drive circuits 801-1~801-8 each with the 384-channel, 128-pixel output as shown in FIG. 8, and the liquid crystal display apparatus accepts the display data having a resolution of 640×480 pixels and a total lateral pixel number of 800 pixels including an ineffective display interval of one line as shown in FIGS. 9, 10. Namely, the display data for the pixels of 400 clock cycles in one line are inputted to the liquid crystal display apparatus.

The display with the expansion rate of 1.6 may be realized by expanding 10 pixels to 16 pixels. This requires the controller 803 to repeatedly output the multiscan control signal 109 indicating a set of combinations including "011" (four pixel expansion), "010" (three pixel expansion-right pixel expansion), "010 ", "001" (three pixel expansion-left pixel expansion) and "001". Here, a uniform display may be attained since the expanded data and non-expanded data appear in turn with almost the same frequency in a train of data.

For example, the first to tenth display data are expanded and converted to an array of the display data 1, 1, 2, 2, 3, 4, 4, 5, 6, 6, 7, 7, 8, 9, 9, 10. In other words, 80 pixel data are inputted to each one of the liquid crystal drive circuits 801, and are converted to 128 pixel data, 1.6 times the input data. Accordingly, the display data of 640 pixels in the lateral direction may be expanded to 1024 pixels so as to carry out display at all the pixels in the lateral direction of the liquid crystal panel.

When the expansion rate for the display is 1.0, 640 pixels out of the 1024 pixels in the lateral direction of the liquid crystal panel are displayed using the data during the effective display interval, and the remaining 384 pixels (192 pixels for each of the left and right sides) are displayed using the data during the ineffective display interval.

Here, the total number of the pixels in one line of the input display data is 800, and the ineffective display interval is for 160 pixels. Therefore, the ineffective display interval data are not enough to fill all of the remaining 384 pixels as is. Further, 192 pixels from each side of the liquid crystal panel are required to be displayed using the ineffective display interval data so as to display the 640 pixels of the effective display interval at the center of the liquid crystal panel. Therefore, the controller 803 outputs the multiscan control signal 109 indicating "111" (all pixel parallel latch) and "110" (64 pixel parallel latch) to fill the 192 pixels from the left edge with the data for the two pixels in the ineffective display interval, and then changes the multiscan control signal 109 to "000" (no expansion) to output of the 640 pixel data and display the data during the effective display interval. Further, the controller 803 outputs the multiscan control signal 109 indicating "110" and "111" to fill the remaining 192 pixels with the data for the two pixels in the ineffective display interval. The total number of pixels required for the display is 644. In clock cycles, an interval of 324 clock cycles is long enough to fill out the entire liquid crystal panel as well as to conduct the centering display.

Accordingly, it is possible to expand the low resolution display data for displaying at the high resolution liquid crystal panel, or to execute the centering operation for displaying the data at the center of the liquid crystal panel.

In the first embodiment described above, the lateral expansion with an expansion rate of 1.0 to 2.0 is realized with the two pixel data latch (1.0 time), the two pixel data-three pixel conversion latch (1.5 times), or the two pixel data-four pixel conversion latch (2.0 times), and the lateral centering is realized with the 64 pixel parallel latch and the all pixel (128 pixels) parallel latch. Alternatively, it is also possible to realize the expansion latching function of a different expansion rate or the centering function with the parallel latch of a different number by changing the definition of the multiscan control signal, the number of the latch clock parallel outputs, the data selection operation of the data control circuit, and the definition of the enable signal in correspondence with the alternative function to be executed.

Furthermore, although it is assumed to have the 6-bit 384-channel 128-pixel output in the instant embodiment, the present invention may also be embodied with a different output number while changing bit length or bit widths in each of the circuits in correspondence with the different output number.

A liquid crystal driver in the second embodiment of the present invention will now be explained with reference to FIG. 8, FIG. 11 and FIG. 12.

Figure 11:
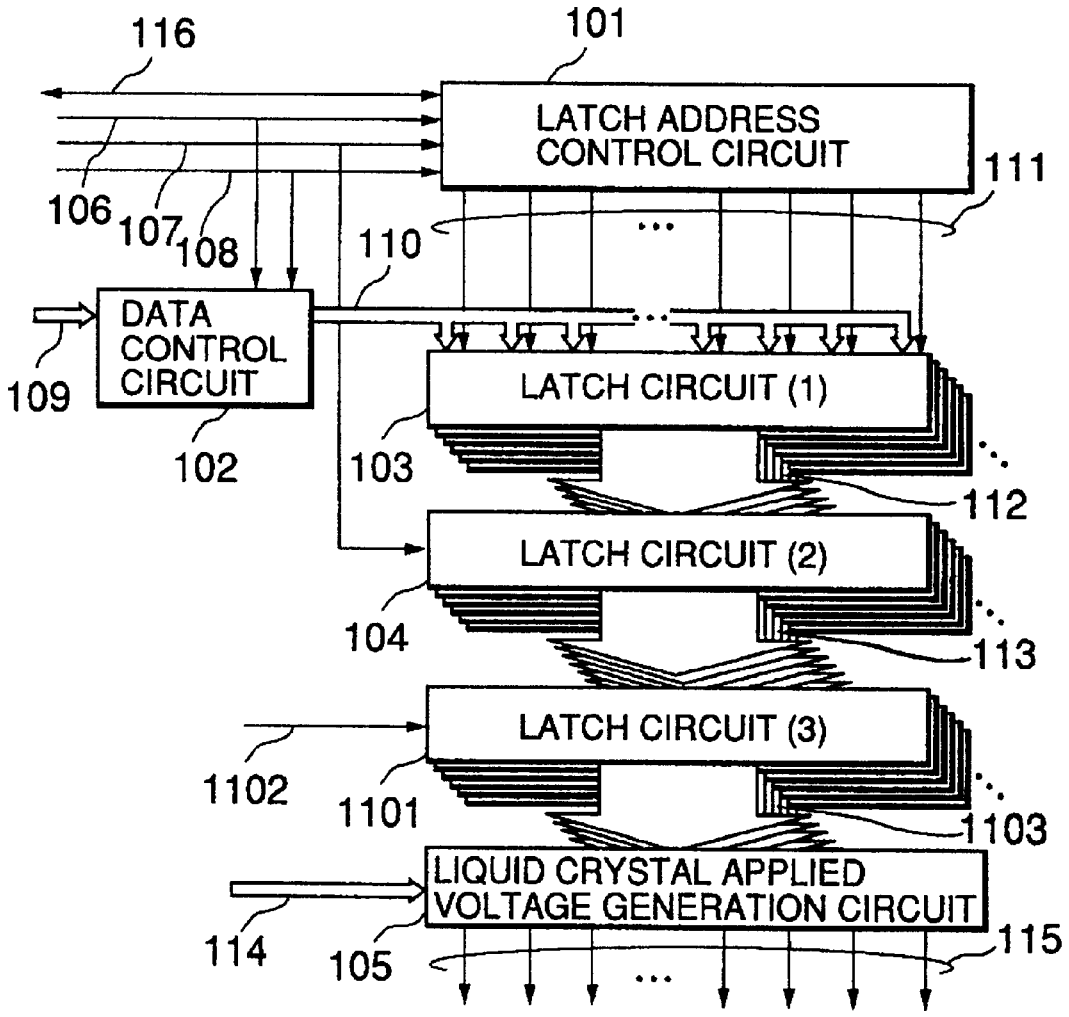
FIG. 11 is a block diagram showing a schematic configuration of a liquid crystal drive circuit in the second embodiment of the present invention.

FIG. 11 is a block diagram of the liquid crystal drive circuit in the second embodiment of the present invention. In FIG. 11, 1101 indicates a latch circuit (3), 1102 indicates an expanded line clock, and 1103 indicates latch circuit (3) output data.

Operations of the liquid crystal drive circuit of the present invention will now be described with reference to a block diagram shown in FIG. 11.

The liquid crystal drive circuit of the present invention further realizes a display with a longitudinal expansion.

First, a data latch operation is conducted in the same way as that of the first embodiment.

Next, a data output operation will be described.

As shown in FIG. 11, the latch circuit (2) 104 latches the latch circuit (1) output data 112 at a timing when the line clock turns active after all the input display data of one horizontal interval have been latched by the latch circuit (1) 103.

The latch circuit (2) output data 113 are latched by the latch circuit (3) 1101 at a timing of the expanded line clock 1102 having a frequency determined by multiplying an expansion rate and a frequency of the line clock 107.

The latch circuit (3) output data 1103 are inputted to the liquid crystal applied voltage generation circuit 105. The liquid crystal applied voltage generation circuit 105 selects gray scale voltages generated from the base voltage 114 for every pixel, buffers the selected voltages, and then outputs the selected voltages as the liquid crystal applied voltage outputs 115.

Accordingly, it is possible to execute the data output operation.

Next, a longitudinal expansion operation of the data output operation will now be described. Here, an example is explained in detail with reference to FIG. 12 when the latch circuit (3) 1101 comprises level latches and the longitudinal expansion rate is 1.6.

Figure 12:
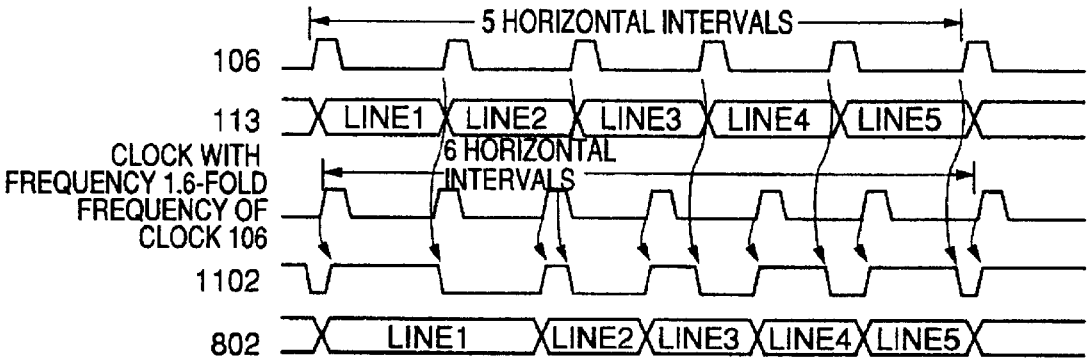
FIG. 12 is a timing diagram during a display data longitudinal expansion operation of the liquid crystal drive circuit in the second embodiment of the present invention.
Figure 13:
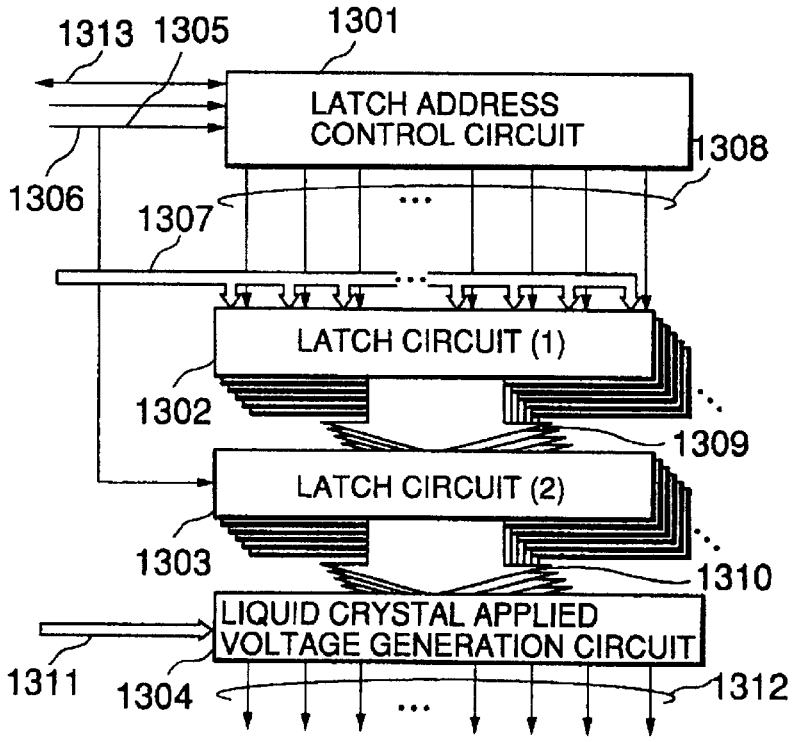
FIG. 13 is a block diagram showing a schematic internal configuration of a liquid crystal drive circuit of the prior art.
Figure 14:
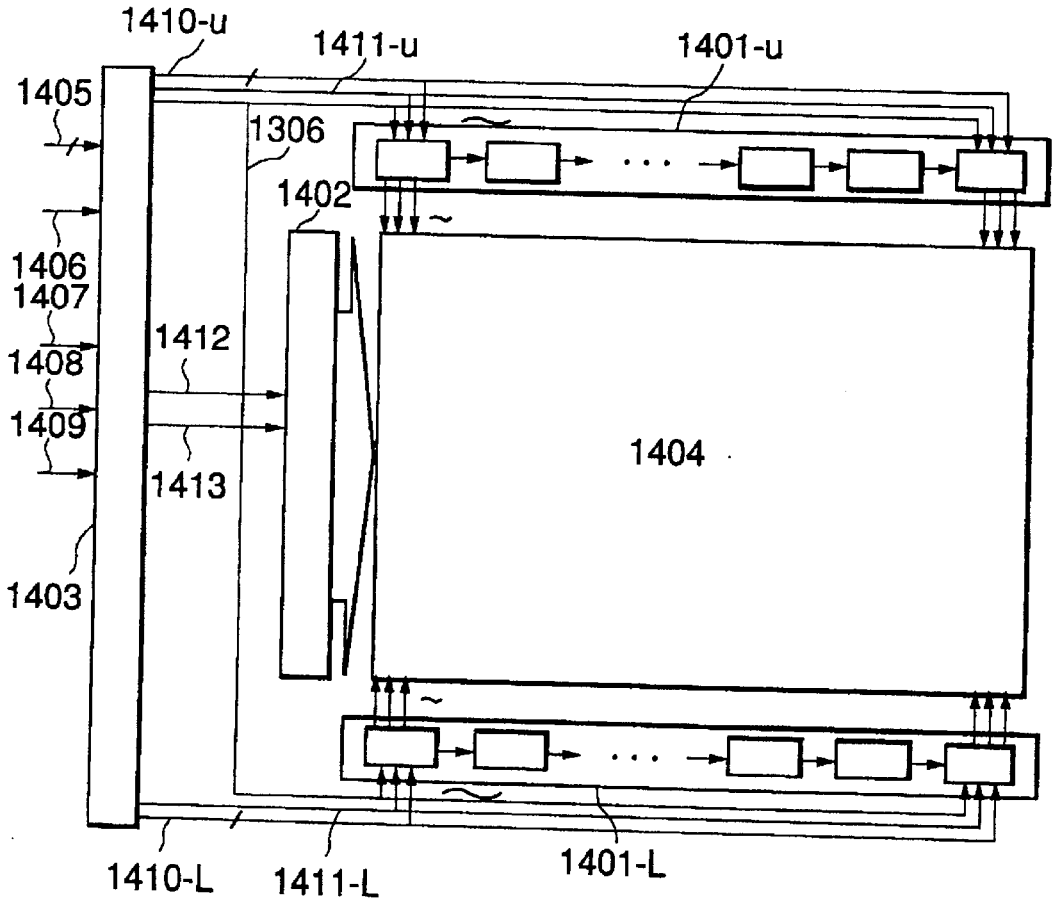
FIG. 14 is a block diagram showing a schematic configuration of a liquid crystal display apparatus utilizing the liquid crystal drive circuit of the prior art.
Figure 15:
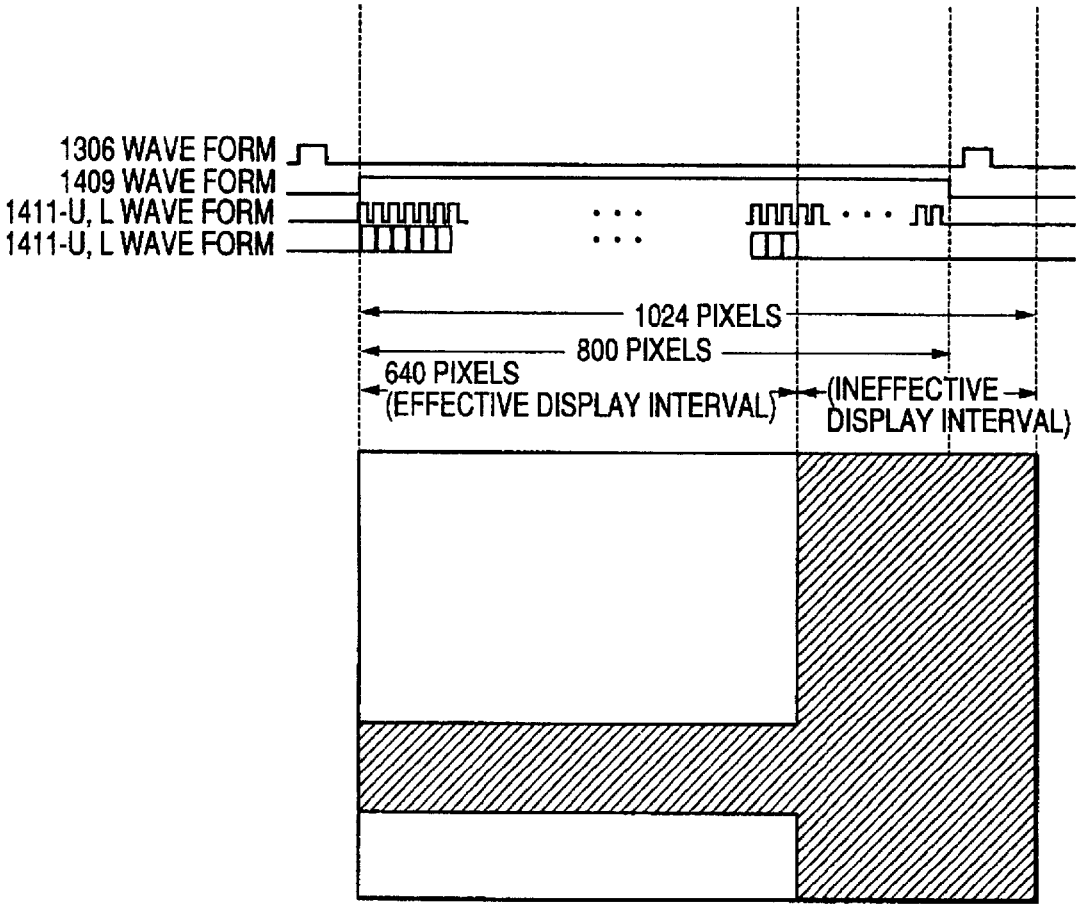
FIG. 15 is an illustration of the display of the liquid crystal display apparatus utilizing a liquid crystal drive circuit of a prior art.

As shown in FIG. 12, five horizontal intervals of the line clock 106 equals six horizontal intervals of the 1.6-fold line clock when the expansion rate is 1.6. Timings of these two sync signals are adjusted so that their leading edges do not coincide.

The expanded line clock 1102 is a latch signal for the latch circuit (3) 1101, and changes to high level at a leading edge of the 1.6-fold line clock and to low level at a leading edge of the line clock 107.

First, the latch circuit (2) 104 latches by a clock which is delayed on the line clock by a certain amount for delaying the latch circuit (2) output data 113 so as to prevent changes of the latch circuit (2) output data 113 in the vicinity of the trailing edge of the expanded line clock 1102.

Next, the latch circuit (3) 1101 latches the latch circuit (2) output data 113 according to the expanded line clock 1102. The latch circuit (3) output data 1103 are outputted in synchronization with the 1.6-fold line clock. The data of the line 1 are outputted for two horizontal intervals continuously, and then the data of the lines 2, 3, 4, 5 are outputted, each for a single horizontal interval, and these operations are repeated.

Accordingly, it is possible to realize the longitudinal expansion by converting the data of five input lines into data of six lines synchronizing with the 1.6-fold line clock, when the expansion rate of 1.6 is set.

With a liquid crystal module utilizing the liquid crystal drive circuit with the longitudinal expansion function of the present invention described above, it is possible to realize the longitudinal expansion display of the input display data having a different display pixel number than the display pixel number of the liquid crystal panel. This will now be explained using FIG. 8 of the first embodiment.

In FIG. 8, the liquid crystal drive circuits 801-1 to 801-8 are assumed to have the longitudinal expansion function of the present invention. The liquid crystal drive circuits 801-1 to 801-8 accept inputs of the expanded line clock 1102 (not shown in FIG. 8) having 1.6 times the frequency of the line clock 107, and output the liquid crystal apply voltages at a timing of the expanded line clock 1102.

Inputting a clock with the same frequency as the expanded line clock 1102 to the scanning driver 802 as the shift clock 811 and turning the first line marker 810 active, the scanning driver 802 selects lines successively starting from the first line in synchronization with the shift clock 811. Therefore, when the display data of 640×480 pixels are inputted, the display is realized by expanding 480 lines in the longitudinal direction into 768 lines, 1.6 times the 480 lines.

Accordingly, it is possible to realize a display at the high resolution liquid crystal panel by expanding the low resolution display data.

Here, in the second embodiment, the latch circuit (3) 1101 is assumed to comprise the level latches. However, the present invention may still be applicable even if edge latches are utilized instead. In this case, the expanded line clock may be replaced by a 1.6-fold line clock. Further, the present invention is also applicable for a different expansion rate as long as the line clock 107 and the 1.6-fold line clock are defined so as not to coincide at their leading edges. The expansion rate is set to a value of 1.0 or larger since the objective is expansion.

Effects attained by the inventions disclosed in the present application may be summarized as follows.

Namely, there is an effect of enabling the lateral expansion and the lateral centering when the inventions are applied onto a liquid crystal display apparatus conducting a multiscan display at its liquid crystal panel.

Further, there is an effect of enabling longitudinal expansion even with a conventional scanning driver having no longitudinal expansion function.

For example, it is possible to convert the display data of 640×480 pixels into the 1024×768 pixel data by expanding to 1.6-fold to display the data at the 1024×768 pixel liquid crystal panel. It is also possible to display the display data of 640×480 pixels at the center of the liquid crystal panel with its own original resolution while displaying the ineffective display interval data on left and right sides of the display area of the liquid crystal panel. Namely, the display data of various resolutions may be displayed in good quality.

What is claimed is:

1. A liquid crystal drive device for converting display data represented by pixel data pieces synchronized with clock signals into liquid crystal applied voltages, comprising:

a plurality of driving lines each of which is coupled to each column of a liquid crystal panel to output said liquid crystal applied voltage to the coupled column for driving one pixel corresponding to the coupled column and a selected row of said liquid crystal panel; and a hold unit which latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals being synchronized with said clock signals and commanding conversion of said display data, and said hold unit outputs to each of said driving lines said liquid crystal applied voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of three adjacent driving lines for said two adjacent pixel data pieces, when said multiscan control signals inputted therein synchronously with said clock signals used for latching said two adjacent pixel data pieces represent command data for specifying a conversion of two pixel data pieces to three pixels.

2. A liquid crystal drive device for converting display data represented by pixel data pieces synchronized with clock signals into liquid crystal applied voltages, comprising:

a plurality of driving lines each of which is coupled to each column of a liquid crystal panel to output said liquid crystal applied voltage to the coupled column for driving one pixel corresponding to the coupled column and a selected row of said liquid crystal panel; and a hold unit which latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals being synchronized with said clock signals and commanding conversion of said display data, and said hold unit outputs to each of said driving lines said liquid crystal applied voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of four adjacent driving lines for said two adjacent pixel data pieces, when said multiscan control signals inputted therein synchronously with said clock signals used for latching said two adjacent pixel data pieces represent command data for specifying a conversion of two pixel data pieces to four pixels.

3. A liquid crystal drive device for converting display data represented by pixel data pieces synchronized with clock signals into liquid crystal applied voltages, comprising:

a plurality of driving lines each of which is coupled to each column of a liquid crystal panel to output said liquid crystal applied voltage to the coupled column for driving one pixel corresponding to the coupled column and a selected row of said liquid crystal panel; and a hold unit which latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals being synchronized with said clock signals and commanding conversion of said display data, and said hold unit outputs to each of said driving lines said liquid crystal applied voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of 128 adjacent driving lines for said two adjacent pixel data pieces, when said multiscan control signals inputted therein synchronously with said clock signals used for latching said 2 adjacent pixel data pieces represent command data for specifying a 64-pixel parallel latching.

4. A display apparatus for converting display data represented by pixel data pieces synchronized with clock signals into voltages, comprising:

a plurality of driving lines each of which is coupled to each column of a display panel to output said voltage to the coupled column for driving one pixel corresponding to the coupled column and a selected row of said display panel; and a hold unit which latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals being synchronized with said clock signals and commanding conversion of said display data, and said hold unit outputs to each of said driving lines said voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of three adjacent driving lines for said two adjacent pixel data pieces, when said multiscan control signals inputted therein synchronously with said clock signals used for latching said two adjacent pixel data pieces represent command data for specifying a conversion of two pixel data pieces to three pixel.

5. A display apparatus for converting display data represented by pixel data pieces synchronized with clock signals into voltages, comprising:

a plurality of driving lines each of which is coupled to each column of a display panel to output said voltage to the coupled column for driving one pixel corresponding to the coupled column and a selected row of said display panel; and a hold unit which latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals begin synchronized with said clock signals and commanding conversion of said display data, and said hold unit outputs to each of said driving lines said voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of four adjacent driving lines for said two adjacent pixel data pieces, when said multiscan control signals inputted therein synchronously with said clock signals used for latching said two adjacent pixel data pieces represent command data for specifying a conversion of two pixel data pieces to four pixels.

6. A display apparatus for converting display data represented by pixel data pieces synchronized with clock signals into voltages, comprising:

a plurality of driving lines each of which is coupled to each column of a display panel to output said voltage to the coupled column for driving one pixel corresponding to the coupled column and a selected row of said display panel; and a hold unit which[]latches said pixel data pieces sequentially according to said clock signals inputted therein for holding said pixel data pieces for one horizontal line of said display data, wherein said hold unit holds said pixel data pieces so that said hold unit allows an identical pixel data piece to be outputted to a plurality of driving lines in accordance with multiscan control signals, said multiscan control signals being synchronized with said clock signals and commanding conversion of said display data, and said hold unit outputs to each of said driving lines said voltage of said pixel data piece corresponding to said driving line concerned, wherein said hold unit includes a latch address controller which generates at least one address of said driving lines for one pixel data piece, according to said multiscan control signals inputted therein synchronously with said clock signals used for latching said one pixel data piece, and correlates said one pixel data piece with at least one of said driving lines specified by said at least one address thus generated, wherein said hold unit latches two adjacent pixel data pieces in parallel according to said clock signals inputted therein, and said latch address controller generates addresses of 128 adjacent driving lines for said two adjacent pixel data pieces, when said multiscan control signals inputted therein synchronously with said clock signals used for latching said two adjacent pixel data pieces represent command data for specifying a 64-pixel parallel latching.

* * * * *